US010961675B2

(12) United States Patent
Ramaekers et al.

(10) Patent No.: US 10,961,675 B2
(45) Date of Patent: Mar. 30, 2021

(54) TRAFFIC BARRIER AND MOUNTING ASSEMBLY

(71) Applicant: Laura Metaal Holding B.V., Eygelshoven (NL)

(72) Inventors: Nicky Joseph Gerardus Ramaekers, Noorbeek (NL); Michael Sean Van der Vlist, Mechelen (NL)

(73) Assignee: Laura Metaal Holding B.V., Eygelshoven (NL)

( * ) Notice: Subject to any disclaimer, the term of this patent is extended or adjusted under 35 U.S.C. 154(b) by 0 days.

(21) Appl. No.: 16/468,163

(22) PCT Filed: Nov. 20, 2017

(86) PCT No.: PCT/NL2017/050753
§ 371 (c)(1),
(2) Date: Jun. 10, 2019

(87) PCT Pub. No.: WO2018/111090
PCT Pub. Date: Jun. 21, 2018

(65) Prior Publication Data

US 2019/0330813 A1 Oct. 31, 2019

(30) Foreign Application Priority Data

Dec. 16, 2016 (NL) ..... 2018015

(51) Int. Cl.
*E01F 15/00* (2006.01)
*E01F 15/08* (2006.01)

(52) U.S. Cl.
CPC ..... *E01F 15/088* (2013.01)

(58) Field of Classification Search
CPC ..... E01F 15/006; E01F 15/08; E01F 15/088; E01F 15/145; E01F 15/146
See application file for complete search history.

(56) References Cited

U.S. PATENT DOCUMENTS 6,962,459 B2 * 11/2005 Smith ..... E01F 15/146 404/6
7,306,397 B2 * 12/2007 Albritton ..... E01F 15/0423 404/6
7,389,860 B2 * 6/2008 Abu-Odeh ..... B62D 21/15 188/377
7,597,501 B2 * 10/2009 Alberson ..... E01F 15/146 404/10

(Continued)

FOREIGN PATENT DOCUMENTS

AT 413712 B 5/2006
DE 19525243 A1 * 1/1997 ..... E01F 15/146

(Continued)

*Primary Examiner* — Thomas B Will
*Assistant Examiner* — Katherine J Chu
(74) *Attorney, Agent, or Firm* — The Webb Law Firm

(57) ABSTRACT

The present invention relates to a mounting assembly (3) for mounting a traffic barrier (1) to a surface, comprising: an attachment base (5) configured to be stationary connected with the traffic barrier; and a ground connecting element (7), configured to be stationary connected with the ground by means of fastening means, such as screws, pins or bolts. The invention further relates to a traffic barrier comprising such a mounting assembly.

15 Claims, 5 Drawing Sheets

(56) References Cited

U.S. PATENT DOCUMENTS

| | | | | |
|---|---|---|---|---|
| 7,871,220 | B2 * | 1/2011 | Albritton | E01F 15/0423 404/6 |
| 8,061,925 | B2 * | 11/2011 | Volkmann | E01F 15/088 256/13.1 |
| 8,061,926 | B2 * | 11/2011 | Riddell | E01F 15/088 404/6 |
| RE43,927 | E * | 1/2013 | Buehler | E01F 15/146 256/13.1 |
| 8,596,903 | B2 * | 12/2013 | Hur | E01F 15/146 404/6 |
| 10,844,560 | B2 * | 11/2020 | Ramaekers | E01F 15/08 |
| 2006/0193688 | A1 * | 8/2006 | Albritton | E01F 15/146 404/6 |
| 2007/0194292 | A1 * | 8/2007 | Serafin | E01F 15/025 256/13.1 |
| 2008/0067484 | A1 * | 3/2008 | Amengual Pericas | E01F 15/043 256/13.1 |
| 2012/0037865 | A1 * | 2/2012 | Von Linsingen-Heintzmann | E01F 15/085 256/13.1 |

FOREIGN PATENT DOCUMENTS

| | | | | |
|---|---|---|---|---|
| EP | 1380695 | A2 | 1/2004 | |
| KR | 100577930 | B1 * | 5/2006 | E01F 15/146 |
| WO | 2008062196 | A1 | 5/2008 | |

* cited by examiner

TRAFFIC BARRIER AND MOUNTING ASSEMBLY

CROSS-REFERENCE TO RELATED APPLICATIONS

This application is the United States national phase of International Application No. PCT/NL2017/050753 filed Nov. 20, 2017, and claims priority to Dutch Patent Application No. 2018015 filed Dec. 16, 2016, the disclosures of which are hereby incorporated by reference in their entirety.

BACKGROUND OF THE INVENTION

Field of the Invention

The present invention relates to a mounting assembly for mounting a traffic barrier to a surface. The invention further relates to a traffic barrier comprising such a mounting assembly.

Description of Related Art

Traffic barriers are commonly used to bound carriageways to protect traffic from roadside obstacles or hazards or to prevent vehicles from crossing over a median and striking an oncoming vehicle. To provide their function in the case of a vehicle collision, traffic barriers have to handle the forces exerted on the traffic barrier by a vehicle colliding with the traffic barrier, without larger displacement than according their specifications is allowed. For this purpose, traffic barriers of a permanent nature are commonly fixed to the ground by means of mounting assemblies that typically consist of bolts or pins that are driven into the road surface. A problem may arise in the situation when one or more of the mounting assemblies break, disconnect from the traffic barrier and/or when the mounting assemblies come loose from their position due to a considerable force being exerted on the traffic barrier as a result of the impact of a vehicle onto the traffic barrier. As a result of the fixation of the traffic barrier, the disconnected traffic barrier is no longer anchored enabling at least part of the traffic barrier to shift and/or to turn over, preventing a correct functioning of the traffic barrier.

It is therefore a goal of the present invention to overcome the drawbacks related to the know traffic barriers by providing a mounting assembly that has enhanced functionality, both in secure positioning of the barrier as in withstanding substantial loads.

SUMMARY OF THE INVENTION

The present invention thereto provides a mounting assembly for mounting a traffic barrier to a surface, comprising: an attachment base configured to be stationary connected with the traffic barrier; and a ground connecting element, configured to be stationary connected with the ground by means of fastening means, such as screws, pins or bolts; wherein the attachment base and the ground connecting element are mutually coupled by coupling means configured to allow movement between the attachment base and the ground connecting element in coupled condition. A stationary connection is hereby understood as a fixed connection, wherein the connected parts are intended to retain their relative position to the ground or the traffic barrier as the case may be. The mounting assembly according to the invention on the one hand effectively secures the traffic barrier to the ground (such as a road or a roadside/shoulder) by stationary connecting the ground connecting element to the ground through the use of fastening means. The fastening means and the ground connecting element prevent mutual movement in fastened condition. On the other hand, the mounting assembly allows for movement of the traffic barrier with respect to the ground/the ground connecting element up to a certain extend due to the coupling means provided on the attachment base and the ground connecting element that are configured to allow the attachment base and the ground connecting element to mutually move. This results in a traffic barrier that is anchored to the ground while able to move with the vehicle in a direction perpendicular to the longitudinal direction of the traffic barrier as a vehicle collides with the traffic barrier to a limited extend, lengthening the time over which the vehicle's momentum is changed while absorbing energy thus decreasing the maximum force of impact on both the vehicle as well as the traffic barrier. This decreased maximum force of impact reduces the risk of breakage of the mounting assembly causing an uncontrolled positioning of the traffic barrier. As a colliding vehicle is allowed to more gradually decelerate, this will also limit the physical harm to the vehicle's passengers.

In an embodiment of the mounting assembly according to the invention, the mutual movement allowed by the coupling means may be a linear movement. As the coupling means are configured to allow only a linear relative movement of the attachment base and the ground connecting element, the traffic barrier is able to move along a linear path. Bounding the movement direction of the traffic barrier leads to an increased control of the traffic barrier's displacement upon impact of a vehicle. As such, the outcome of an impact may be better predicted and the chance of tumbling over of the traffic barrier is diminished resulting in enhanced safety for the colliding vehicle's passengers as well as persons and object in the environment of the traffic barrier.

Specifically, the mutual movement allowed by the coupling means may have a direction perpendicular to the longitudinal axis of the traffic barrier. The traffic barrier normally extends in a direction parallel to the road, thereby having its longitudinal axis parallel to said road. As a consequence, a vehicle crashing into the traffic barrier needs to be decelerated (mainly) in a direction perpendicular to the direction of travel. It is in this direction that the traffic barrier must be able to limit the vehicle's movement. In order for the traffic barrier to effectively aid the gradual deceleration of the vehicle in the direction perpendicular to the longitudinal axis of the traffic barrier, the traffic barrier is likely to displace in this direction as well. As an alternative or additionally the traffic barrier may also deform while absorbing energy. Anyhow it is advantageous if the coupling means allow for mutual movement in the direction perpendicular to the longitudinal axis of the traffic barrier. Alternatively, the coupling means may allow for a mutual movement of the attachment base and the ground connecting element having just a component in the direction perpendicular to the longitudinal axis of the traffic barrier.

In an alternative embodiment of the mounting assembly according to the invention, the coupling means comprise a protrusion and a receiving space for receiving the protrusion therein and thereby coupling the attachment base and the ground connecting element. Specifically it may be that one of the attachment base and the ground connecting element comprises the protrusion and the other of the attachment base and the ground connecting element comprises the receiving space, for example constituted by a recess. Given that the receiving space is dimensioned larger than the protrusion in that the circumference of the inner peripheral wall of the receiving space exceeds the circumference of the outer peripheral wall of protrusion, mutual movement between the attachment base and the ground connecting element is allowed in coupled condition.

By means of varying the respective sizes and shapes of the protrusion and receiving space, the allowed mutual movement may be effectively influenced. The receiving space may be elongated in a direction of mutual movement of the attachment base and the ground connecting element. To further guarantee the effective guidance of the mutual movement of the attachment base and the ground connecting element, the protrusion may be elongated in the longitudinal direction of the receiving space. The protrusion may furthermore have a width substantially equal to the width of the receiving space, thereby connecting to the opposing longitudinal sides of the receiving space to limit the mutual movement in the longitudinal direction of the receiving space.

In a further embodiment of the mounting assembly according to the invention, at least one of the protrusion and the receiving space is configured to at least partially plastically deform upon mutual movement. At least part of the kinetic energy of the colliding vehicle is hereby dissipated through the plastically deformation of one of the protrusion and the receiving space, causing the vehicle to more gradually decelerate to minimize the deceleration experienced by the passengers as well as minimizing damage to the vehicle.

In a specific embodiment of the coupling means, the receiving space is configured to tear upon movement relative to the protrusion. The receiving space for receiving the protrusion may for this purpose be a substantially longitudinal aperture with a narrowing width. The narrowing width of the aperture hereby acts as a constricting portion for the protrusion moving along the aperture. As the protrusion moves along a narrowing receiving space with the mutual movement between the attachment base and the ground connecting element, the width of the protrusion exceeds the width of the receiving space upon which the receiving space will deform to accommodate the protrusion. The aperture may be progressively narrowing towards its longitudinal end sides to increase the amount of deformation necessary to continue the relative movement of the protrusion and the receiving space. As a consequence, the experienced resistance as well as the amount of energy dissipated during this movement will progressively increase. The narrowing width of the aperture may be formed by a continuous narrowing (or a taper in the case of a progressive narrowing) of the aperture in elongate direction. It is however equally possible that the narrowing width of the aperture is achieved by one or more protrusions situated along the peripheral edge of the aperture. These protrusions may increase in size towards the longitudinal end sides of the aperture to achieve a progressive narrowing of the aperture.

In yet a further embodiment of the mounting assembly according to the invention, the attachment base and the ground connecting element are provided with cooperating abutments for limitation of the maximal mutual displacement of the attachment base and the ground connecting element. This limitation of maximal mutual displacement prevents for instance the traffic barrier from shifting so far as to cross onto a parallel lane of traffic or allow a colliding vehicle to hit a roadside obstacle or oncoming traffic. The moment the abutments contact each other, the traffic barrier is commonly at a position of maximum allowable displacement. Any subsequent force acting upon the traffic barrier in the same direction will then deform the traffic barrier, the colliding vehicle, or a combination thereof to stop the vehicle's momentum. The abutments may allow for the mutual displacement of the attachment base and the ground connecting element up to a point where the coupling means reach a mutual extreme position, wherein the protrusion of the coupling means typically reaches an end of aperture receiving said protrusion.

It is possible that the abutments are facing edges of respectively the attachment base and the ground connecting element. As the abutments form an integral part of the attachment base and the ground connecting element, no additional parts are needed to limit the mutual displacement of the attachment base and the ground connecting element. As such, there is no risk of breaking off any such parts due to which the attachment base and the ground connecting element could continue their relative movement past a maximum predefined deflection. In a possible embodiment of the abutments, the facing edges of the attachment base and the ground connecting element are provided with complementary profiles (e.g. castellations) that engage each other, increasing the contact surface of the abutment surfaces, thereby further preventing that the attachment base and the ground connecting element move up past the abutments.

In an advantageous embodiment of the mounting assembly according to the invention, the attachment base at least partially encloses the ground connecting element. Possible movement of the ground connecting element with respect to the attachment base is hereby effectively restricted by the enclosing attachment base, even in case the coupling means mutually coupling the attachment base and the ground connecting element would fail.

To further secure a limited direction of movement of the enclosed ground connecting element, the attachment base may be embodied as a substantially elongated channel. The channel may have a direction of elongation equal to the direction of mutual movement allowed by the coupling means. More specific, this may be the direction perpendicular to the longitudinal axis of the traffic barrier. For optimal cooperation with the enclosing attachment base, the ground connecting element may further have a longitudinal central body part that is at least partially enclosed by the attachment base. The longitudinal axis of the central body hereby may run parallel to, or more specific may coincide with the longitudinal axis of the elongated channel that may make up the attachment base.

The ground connecting element may be provided with apertures on opposite sides for cooperating with the fastening means to stationary connect the ground connecting element to the ground. As the apertures may be provided on opposing sides of the ground connecting element, the apertures are easily accessible from an outside of the traffic barrier, allowing for quick fixation of the ground connecting element and therefore the traffic barrier to the ground. Furthermore a larger distance between cooperating fastening means enhances the stability of the fixation of the traffic barrier, e.g. the stability against turning over (toppling) of the traffic barrier.

To increase the structural integrity of the mounting assembly, the attachment base may be an integrated part of a traffic barrier. By being integrated into the traffic barrier, a solid connection between the traffic barrier and the attachment base—and therewith the mounting assembly—is obtained. This minimises the chance that the traffic barrier breaks off the mounting assembly in case of a substantial impact.

The invention also relates to a traffic barrier comprising a mounting assembly according to any of the above described embodiments or any combination thereof. Commonly, the traffic barrier may comprise a plurality of such mounting assemblies to guarantee a proper and secure connection between the traffic barrier and the ground. The number of mounting assemblies hereby typically depends on the length of the traffic barrier.

In a further embodiment of the traffic barrier according to the invention, the attachment base may be an integrated part of the traffic barrier and the longitudinal may be direction of the attachment base is perpendicular to the longitudinal direction of the traffic barrier. As is mentioned earlier, by letting the attachment base constitute an integrated part of the traffic barrier a solid connection between the traffic barrier and the attachment base and therewith the mounting assembly is obtained, minimising the occurrence that the traffic barrier breaks off the mounting assembly in case of a substantial impact (like a collision). By letting the longitudinal direction of the attachment base run perpendicular to the longitudinal direction of the traffic barrier, the attachment base may be oriented in the direction of preferred mutual movement between the attachment base and the ground connecting element. Especially in the case where the attachment base at least partially encloses the ground connecting element, the possible movement of the ground connecting element with respect to the attachment base is hereby effectively restricted in the direction of preferred movement by the enclosing attachment base.

BRIEF DESCRIPTION OF THE DRAWINGS

The invention will now be elucidated into more detail with reference to non-limitative exemplary embodiments shown in the following figures. Corresponding elements are indicated with corresponding numbers in the figures. In the figures.

DESCRIPTION OF THE INVENTION

Figure 1:
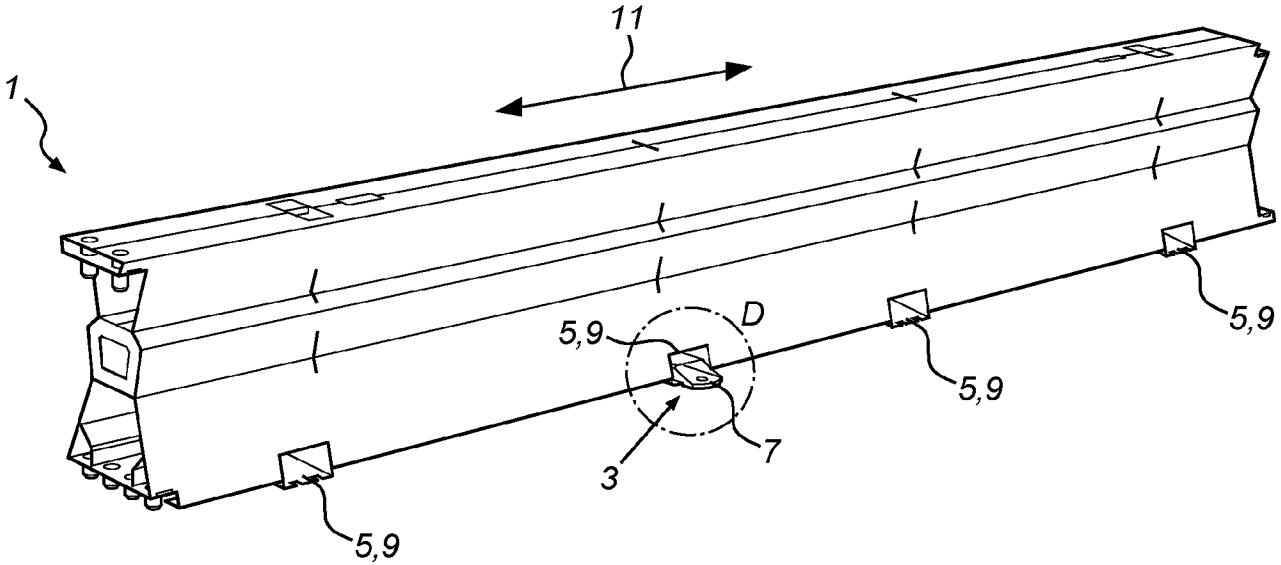
FIG. 1 shows a perspective view of a traffic barrier comprising a mounting assembly according to the invention.

FIG. 1 shows a perspective view of a traffic barrier 1 comprising a mounting assembly 3 according to the invention. The traffic barrier 1 has an elongated shape and is at a bottom side along its length provided with multiple attachment bases 5 that may each form part of a separate mounting assembly 3. The shown mounting assembly 3 comprises an attachment base 5, as well as a ground connecting element 7. The attachment base 5 in the embodiment shown is an integrated part of the traffic barrier 1 and is therefore inherently a stationary part of the traffic barrier 1. It may however be possible that the attachment base 5 constitutes a separate part that is stationary but detachably connected to the traffic barrier 1. The attachment base 5 comprises a longitudinal channel 9, having its longitudinal axis oriented perpendicular to the longitudinal direction 11 of the traffic barrier 1. The channel 9 encloses a longitudinal central body part 13 (see FIG. 2) of the ground connecting element 7. The attachment base 5 and the ground connecting element 7 are mutually coupled by co-operating coupling means provided on the ground connecting element 7 and the attachment base 5 which will be shown in the following figures in more detail. The ground connecting element 7 is provided with apertures 15 (see FIG. 2) on opposite sides for cooperating with fastening means, such as for instance screws, bolts and/or nails, to stationary connect the ground connecting element 7 to the ground. The ground may for example be a roadbed or another artificial construction like for instance a bridge or a ramp.

Figure 2:
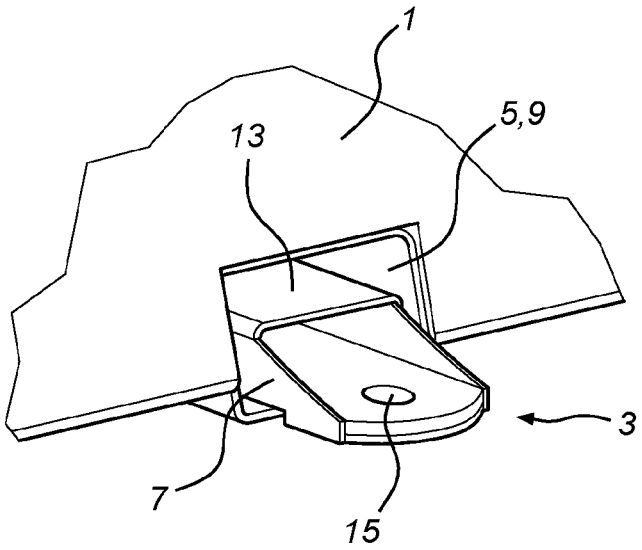
FIG. 2 shows a detailed view on the mounting assembly of the traffic barrier shown in FIG. 1, FIG. 3*a-b* show a perspective view of respectively the top side and the bottom side of a ground connecting element of a mounting assembly according to the invention.

FIG. 2 shows a detailed view on the mounting assembly 3 of the traffic barrier 1 shown in FIG. 1, denoted as "D" in FIG. 1. The attachment base 5 of the mounting assembly, here provided with a longitudinal channel 9, forms a support for the traffic barrier 1. The ground connecting element 7 is coupled to the attachment base 5 such that mutual movement between the attachment base 5 and the ground connecting element 7 is allowed. Opposing sides of the ground connecting element 7 are provided with apertures 15 for passing though fastening means and stationary connecting the ground connecting element 7 to the ground.

Figure 3A:
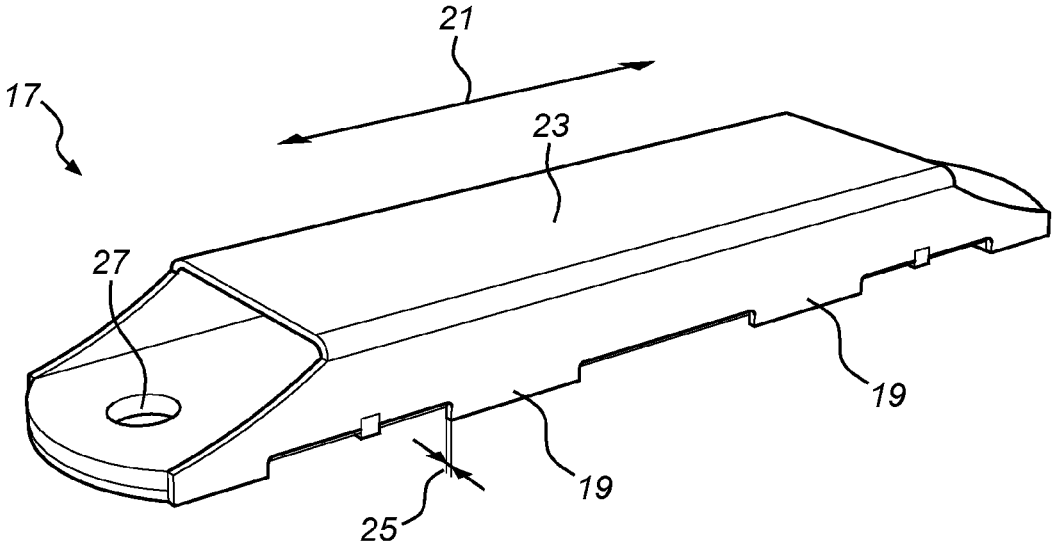

FIG. 3*a* shows a perspective view of the top side of a ground connecting element 17 of a mounting assembly according to the invention. The ground connecting element 17 is at a bottom side provided with elongated protrusions 19 that constitute part of coupling means that are configured to couple the ground connecting element 17 to an attachment base and at the same time allow limited and controlled mutual movement between the attachment base and the ground connecting element 17. The protrusions 19 are configured to be received in a corresponding receiving space (see FIGS. 4 and 5) provided on an attachment base. Note that although the shown ground connecting element 17 is provided with multiple protrusions 19, as an alternative it also possible to use a only a single protrusion 19. It is moreover equally possible that the ground connecting element 17 is provided with one or more receiving spaces for receiving corresponding one or more protrusions provided on an attachment base. The protrusions 19 are elongated in the direction of elongation 21 of the longitudinal central body part 23 of the ground connecting element 17, the latter being configured to be enclosed by a longitudinal channel of an attachment base. The elongated shape allows a protrusion 19 to perform a linear movement relative to a receiving space having a width substantially equal to the width of the protrusion 25. In order to increase the structural rigidity, and specifically the stiffness of the ground connecting element 17, the ground connecting element is formed as a hollow beam-like element. It can furthermore be again seen that opposing sides of the ground connecting element are provided with apertures 27 for passing though fastening means (not shown) and stationary connecting the ground connecting element 17 to the ground.

Figure 3B:
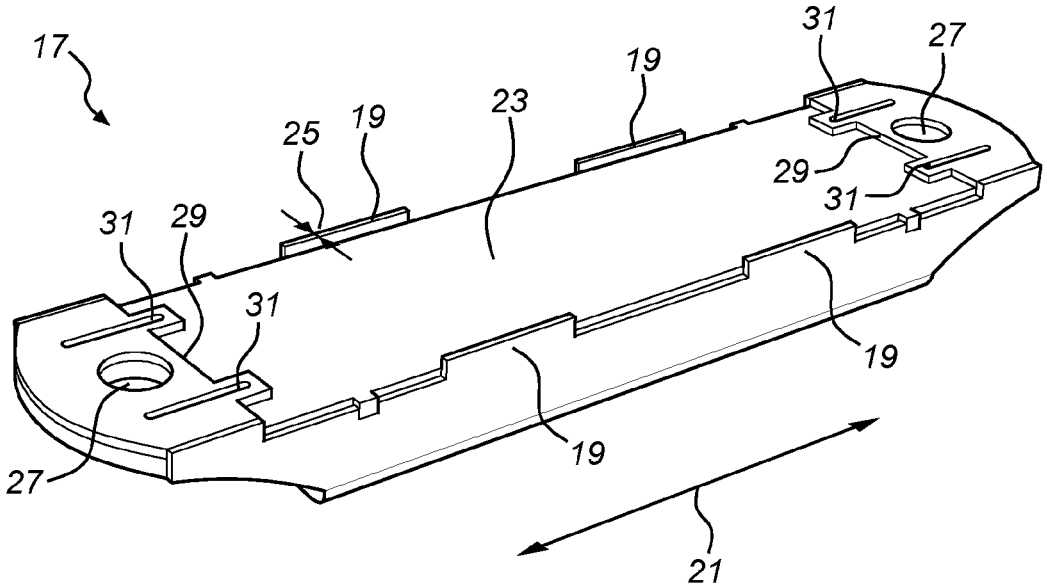

FIG. 3*b* shows a perspective view of the bottom side of a ground connecting element 17 of a mounting assembly according to the invention. Again, the above-discussed protrusions 19 are shown, that co-operate with form-fitting receiving spaces for coupling the ground connecting element 17 to an attachment base and at the same time allowing mutual movement between said attachment base and the ground connecting element 17. Opposing edges 29 on the bottom side of the ground connecting element 17 form abutments for co-operating abutments provided on an attachment base and function to limit the mutual displacement of the attachment base and the ground connecting element 17. The edges 29 of the ground connecting element 17 are provided with profiles complementary to the profile of an abutment provided on an attachment base to increase the contact surface between cooperating abutments. Although the shown profile is formed by castellations 31, the application of any other profile that is complementary to the profile of an abutment provided on an attachment base is possible as well.

Figure 4:
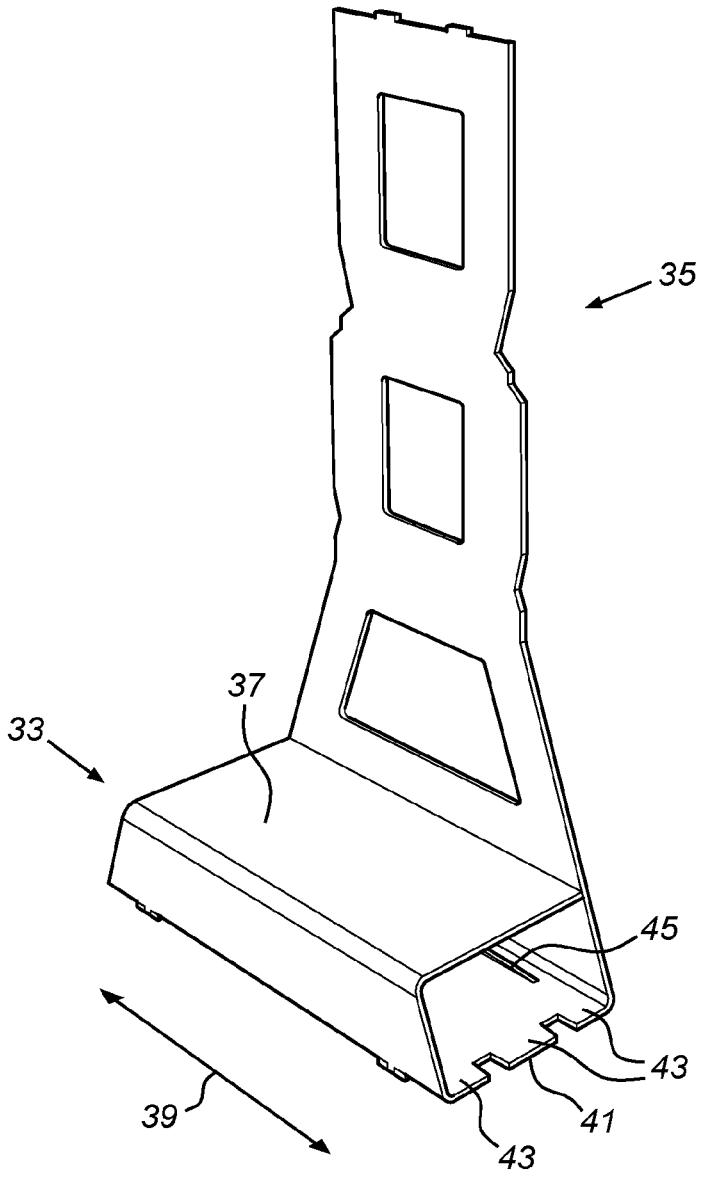
FIG. 4 shows a perspective view of an attachment base of a mounting assembly according to the invention.

FIG. 4 shows a perspective view of an attachment base 33 of a mounting assembly according to the invention, wherein the attachment base 33 is an integral part of a support structure 35 of a traffic barrier (not shown in this figure). The attachment base 33 shown is formed as an elongated channel 37 for enclosing a corresponding ground connecting element. The channel's longitudinal direction 39 is hereby perpendicular to the longitudinal direction of the traffic barrier. The end sides 41 of the channel 37 form abutments that are configured to cooperate with abutments provided on a ground connecting element. The edges of the attachment base 33 are herewith provided with profiles (castellations 43) complementary to the profile of an abutment provided on a ground connecting element to increase the contact surface between cooperating abutments. The attachment base 33 is moreover provided with receiving spaces 45, which are discussed in more detail in the following figure (FIG. 5).

Figure 5:
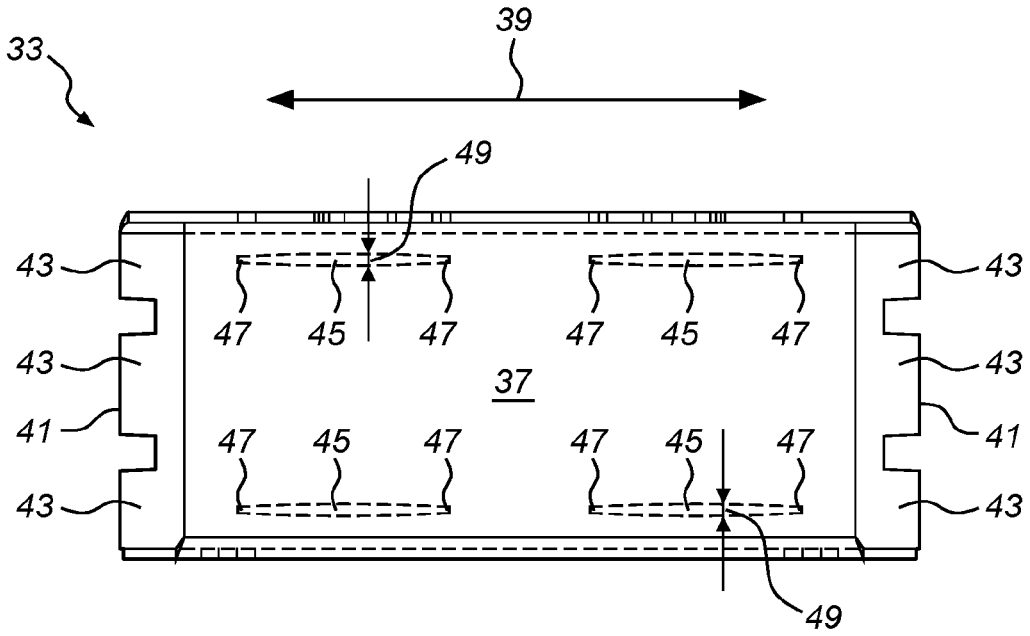
FIG. 5 shows a top view of the attachment base shown in FIG. 4.

FIG. 5 shows a top view of the attachment base 33 shown in FIG. 4. The end sides 41 of the channel 37 form abutments for corresponding abutments provided on a ground connecting element. Also shown are four receiving spaces, formed by longitudinal apertures 45, having a narrowing width at the longitudinal end sides 47 thereof. The apertures 45 are configured to receive corresponding protrusions of the same coupling means. The maximum width 49 of the apertures 45 is therefore preferably chosen to correspond to the width of the protrusions of said same coupling means. The apertures 45 shown in this embodiment of the coupling means are continuous and progressively narrowing (tapered) towards their longitudinal end sides 47. As a result, upon relative movement of the aperture 45 and the protrusion, the width of the protrusion will at an end side 47 of the aperture 45 exceed the width of the aperture upon which the aperture may—in case of substantial impact onto the traffic barrier—deform to accommodate the protrusion. As a consequence of the progressive narrowing, the experienced resistance as well as the amount of energy dissipated during the mutual movement will progressively increase. Note that although the shown apertures 45 are continuous and progressively narrowing towards their longitudinal end sides 47, it is also possible that the narrowing may not be progressive but has a constant width smaller than the width of a corresponding protrusion being received therein. Moreover, the narrowing width of the aperture 45 may be achieved by one or more protrusions situated along the peripheral edge of the aperture 45. These protrusion may increase in size towards the longitudinal end sides 47 of the aperture 45 to achieve a progressive narrowing of the aperture.

It will be apparent that the invention is not limited to the exemplary embodiments shown and described here, but that within the scope of the appended claims numerous variants are possible which will be self-evident to the skilled person in this field. It is possible here to envisage that different inventive concepts and/or technical measures of the above described embodiment variants can be wholly or partially combined without departing from the inventive concept described in the appended claims.

The invention claimed is:

1. A mounting assembly for mounting a traffic barrier to a surface, comprising:

an attachment base configured to be stationary connected with respect to the traffic barrier and adapted to be integrated into the traffic barrier; and a ground connecting element, configured to be stationary connected with respect to a ground by means of fastening means, such as screws, pins or bolts;

wherein the attachment base and the ground connecting element are mutually coupled by coupling means configured to allow movement between the attachment base and the ground connecting element in coupled condition, and the attachment base at least partially encloses the ground connecting element.

2. The mounting assembly according to claim 1, characterised in that the movement allowed by the coupling means is a linear movement.

3. The mounting assembly according to claim 1, characterised in that the movement allowed by the coupling means has a direction perpendicular to the longitudinal axis of the traffic barrier.

4. The mounting assembly according to claim 1, characterised in that the coupling means comprise a protrusion and a receiving space for receiving the protrusion therein and thereby coupling the attachment base and the ground connecting element.

5. The mounting assembly according to claim 4, characterised in that at least one of the protrusion and the receiving space is configured to at least partially plastically deform upon movement.

6. The mounting assembly according to claim 5, characterised in that the receiving space for receiving the protrusion is a substantially longitudinal aperture with a narrowing width.

7. The mounting assembly according to claim 1, characterised in that the attachment base and the ground connecting element are provided with cooperating abutments for limitation of the displacement of the attachment base and the ground connecting element.

8. The mounting assembly according to claim 7, characterised in that the abutments are facing edges.

9. The mounting assembly according to claim 1, characterised in that the attachment base is substantially an elongated channel.

10. The mounting assembly according to claim 1, characterised in that the ground connecting element has a longitudinal central body part that is at least partially enclosed by the attachment base.

11. The mounting assembly according to claim 1, characterised in that the ground connecting element is provided with apertures on opposite sides for cooperating with the fastening means to stationary connect the ground connecting element to the ground.

12. The mounting assembly according to claim 1, characterised in that the attachment base is an integrated part of a traffic barrier.

13. A traffic barrier comprising a mounting assembly according to claim 1.

14. The traffic barrier according to claim 13, characterised in that the traffic barrier comprises plural mounting assemblies.

15. The traffic barrier according to claim 14, characterised in that the attachment base is an integrated part of a traffic barrier and the longitudinal direction of the attachment base is perpendicular to the longitudinal direction of the traffic barrier.

* * * * *